US005785135A

United States Patent [19]

Crawley

[11] Patent Number: 5,785,135

[45] Date of Patent: Jul. 28, 1998

[54] EARTH-BORING BIT HAVING CUTTER WITH REPLACEABLE KERF RING WITH CONTOURED INSERTS

[75] Inventor: Dolph Crawley, Arlington, Tex.

[73] Assignee: Baker Hughes Incorporated, Houston, Tex.

[21] Appl. No.: 724,875

[22] Filed: Oct. 3, 1996

[51] Int. Cl.[6] ..... E21B 9/08

[52] U.S. Cl. ..... 175/373

[58] Field of Search ..... 175/373, 374, 175/376, 426, 431

[56] References Cited

U.S. PATENT DOCUMENTS

| | | | |
|---|---|---|---|
| 2,306,683 | 12/1942 | Zublin | 175/373 X |
| 4,316,515 | 2/1982 | Pessier | 175/378 X |
| 5,234,064 | 8/1993 | Lenaburg | 175/373 |
| 5,253,723 | 10/1993 | Narvestad | 175/373 |
| 5,598,895 | 2/1997 | Anderson et al. | 175/373 |

*Primary Examiner*—William P. Neuder
*Attorney, Agent, or Firm*—James E. Bradley

[57] ABSTRACT

An earth-boring bit or head of the shaft or tunnel boring variety has a generally circular bit body. A plurality of saddle members are secured to bit body to receive and support each end of a plurality of corresponding journal members. A cutter shell or sleeve is mounted for rotation on bearings on each journal member. At least one kerf ring is releasably secured to the cutter shell. The kerf ring includes a pair of opposing sides that converge to define a continuous crest for disintegration of formation material. A plurality of hard metal inserts are embedded and secured in rows to the kerf ring, the inserts being generally flush with the sides and extending to the crest of the kerf ring.

14 Claims, 4 Drawing Sheets

EARTH-BORING BIT HAVING CUTTER WITH REPLACEABLE KERF RING WITH CONTOURED INSERTS

BACKGROUND OF THE INVENTION

1. Field of the Invention

The present invention relates generally to earth-boring bits. More particularly, the present invention relates to the design of cutters for earth-boring bits for boring relatively large-diameter holes in mining and civil construction applications.

2. Background Information

Earth-penetrating tools are divided generally into two broad categories, those designed to drill deep, relatively small-diameter boreholes and those designed to drill shallow, large-diameter boreholes. Earth-boring bits with rolling cutters mounted on cantilevered bearing shafts often are called "rock bits" and are employed in drilling relatively small-diameter boreholes for the recovery of petroleum or hydrocarbons, or to tap geothermal energy sources.

Another type of earth-boring bit or head employs a plurality of rolling cutters, usually in excess of three, arranged to drill relatively large-diameter boreholes for mining, tunnelling, or other civil construction applications. In mining or boring operations, the bit or head is secured to a drilling machine and is rotated and pushed or pulled through formation material to bore a shaft or tunnel. The cutters of these bits generally are divided into two broad categories: those that rely on protruding hard metal, usually tungsten carbide, buttons or inserts to fracture formation material, and those that rely on raised discs to fracture the formation. The cutter assemblies employing tungsten carbide buttons or inserts generate high contact or point loads at generally very small areas in the formation, resulting in relatively small cuttings and fine, abrasive particles of rock. Conversely, the disc cutter assemblies employing rings scribe circles around the formation material to be disintegrated, resulting in spalling of large cuttings or pieces of formation material. The relatively large cuttings resulting from the action of disc cutter assemblies are regarded as preferable to the smaller cuttings generated by the button or insert cutter assemblies because they require less energy-per-volume of rock removed to fracture and are easier to remove from the borehole.

There are generally two types of disc cutter assemblies. In one type, the rings or discs are formed integrally with the cutter shell material, and, when worn, necessitate replacement of the entire cutter shell or sleeve. In another type, the rings are annular kerf rings replaceably secured to the cutter shell or sleeve and can be removed and replaced easily when worn. The kerf rings of the latter type of cutter assembly generally are formed of unreinforced steel or are provided with protruding hard metal inserts to take advantage of both of the fracture modes discussed above. Those formed of unreinforced steel wear too quickly in abrasive rock formations, necessitating frequent replacement. Those kerf rings with excessively protruding inserts tend to operate in a fracture mode more similar to the cutters employing solely hard metal inserts or buttons as the cutting structure, rather than in the more advantageous disc cutter mode.

A need exists, therefore, for a cutter assembly for an earth-boring bit or head that employs the advantageous fracture mode of disc cutters while providing long life and easily replaceable kerf rings.

SUMMARY OF THE INVENTION

It is a general object of the present invention to provide an improved disc-type earth-boring bit or head for mining or civil construction applications. This and other objects of the present invention are achieved by providing a generally circular bit body. A plurality of saddle members are secured to the bit body to receive and support each end of a plurality of corresponding journal members. A cutter shell or sleeve is mounted for rotation on bearings on each journal member.

At least one kerf ring is releasably secured to the cutter shell. The kerf ring includes a pair of opposing sides that converge to define a crest for disintegration of formation material. A plurality of hard metal inserts are embedded and secured in rows to the kerf ring, the inserts being generally flush with the sides and extending to the crest of the kerf ring.

According to a preferred embodiment of the present invention, the inserts in a given kerf ring are separable into groups, each of the groups having varying pitch between the inserts.

According to another preferred embodiment of the present invention, the inserts are arranged such that a first insert is located arbitrarily in the kerf ring, the second insert is randomly located in the kerf ring relative to the first, and a third insert is randomly located relative to the second, such that a dispersed insert pattern results.

According to another embodiment of the present invention, one of the opposing sides of the kerf ring is convex and the other is concave, defining a kerf ring that is curved in cross-section and particularly adapted for gage cutting.

Other objects, features, and advantages of the present invention will become apparent with reference to the drawings and detailed description which follow.

DESCRIPTION OF THE PREFERRED EMBODIMENT

Figure 1:
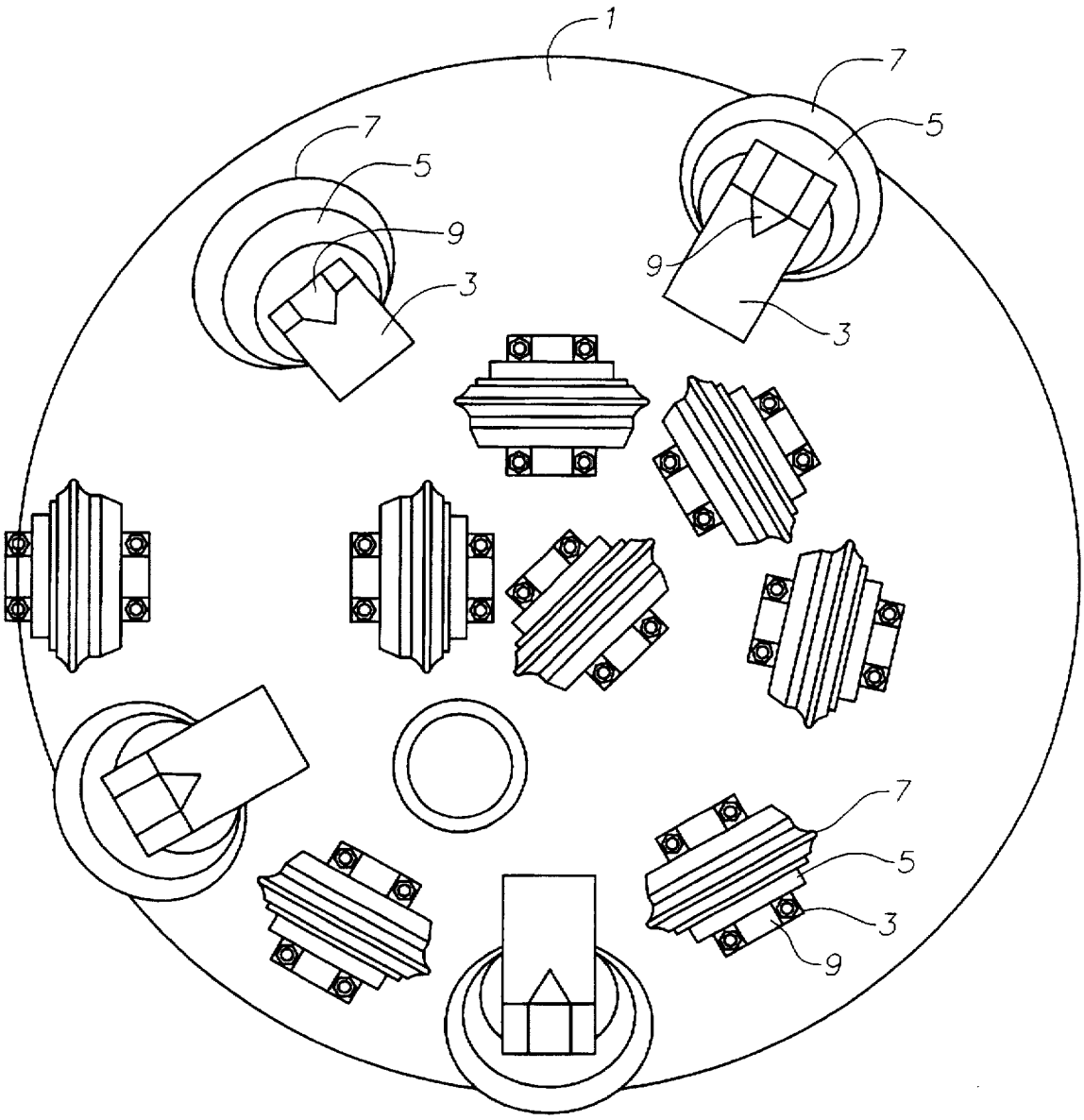
FIG. 1 is a plan view of an earth-boring bit or head of the type contemplated by the present invention.

FIG. 1 is a plan view of an earth-boring bit or head of the shaft or tunnel boring variety of the type contemplated by the present invention. Head 1 comprises a generally circular bit body 1, which is adapted to be connected to a drilling or tunnelling machine (not shown) to be rotated and pushed or pulled through a rock or earthen formation to bore a shaft or tunnel.

A plurality of saddle members 3 are secured to bit body 1 at various selected locations. A cutter shell or sleeve 5 is carried for rotation by a journal member 9, each end of which is secured to and supported by saddle member 3. A preferred method of securing journal members 9 to saddles members 3 is disclosed in commonly assigned U.S. Pat. No. 5,487,453, Jan. 30, 1996 to Crawley et al.

The cutter assemblies carried by bit body 1 are known as disc-type cutters because a raised, annular kerf ring 7 is releasably secured to each cutter sleeve or shell 5. As bit body 1 is rotated and pushed or pulled through the formation, the cutter assemblies and kerf rings 7 engage the formation, scoring it in generally circular patterns and causing the fracture of large cuttings or fragments of rock from the formation. The cuttings removed by disc-type cutters (as opposed to cutters employing discrete hard-metal inserts or buttons as the primary cutting structure), such as those disclosed in FIG. 1, are removed with less energy per volume of rock fractured and produce larger cuttings, which are easier to remove from the shaft or tunnel as boring progresses.

Figure 2:
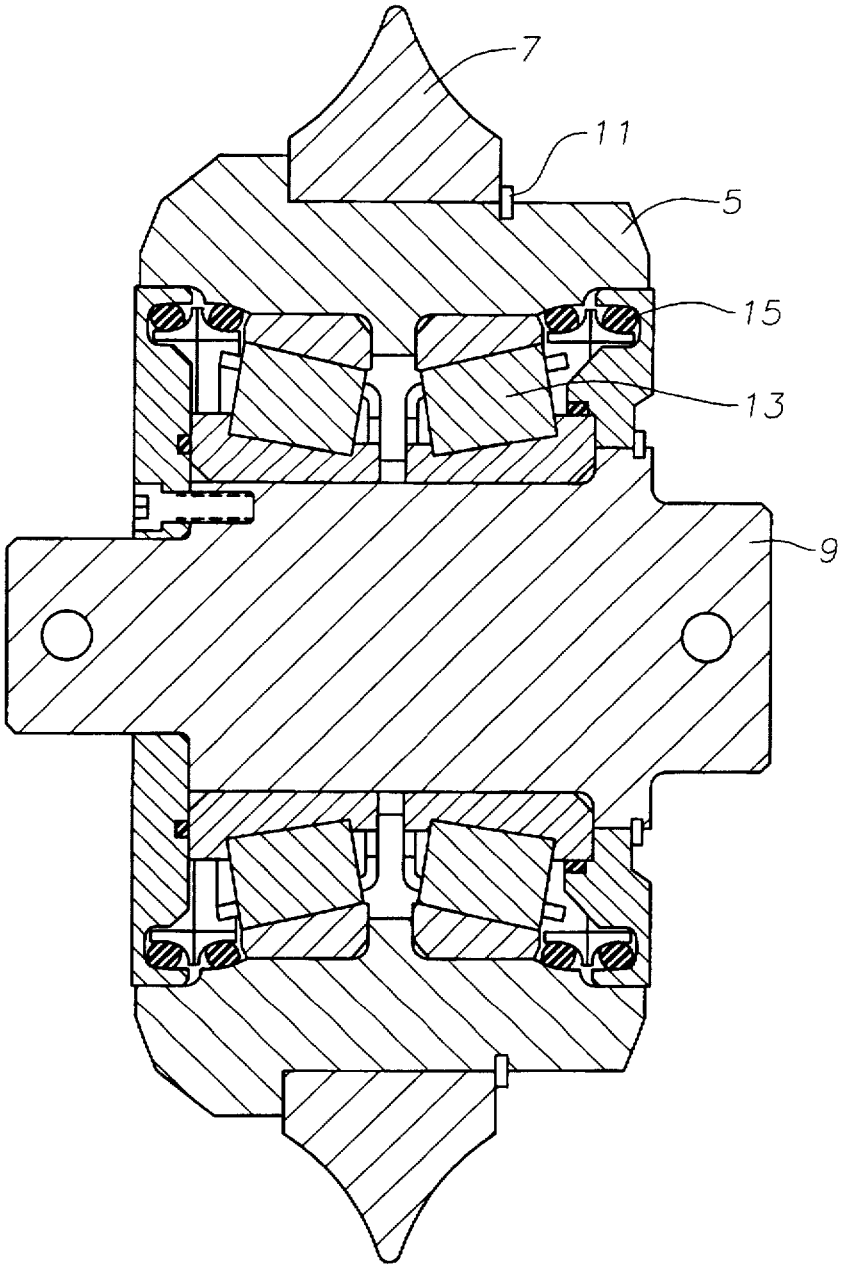
Fig. 2 (PRIOR ART)
FIGS. 2 and 3 are longitudinal section views of prior-art cutter assemblies generally of the type contemplated by the present invention.
Figure 3:
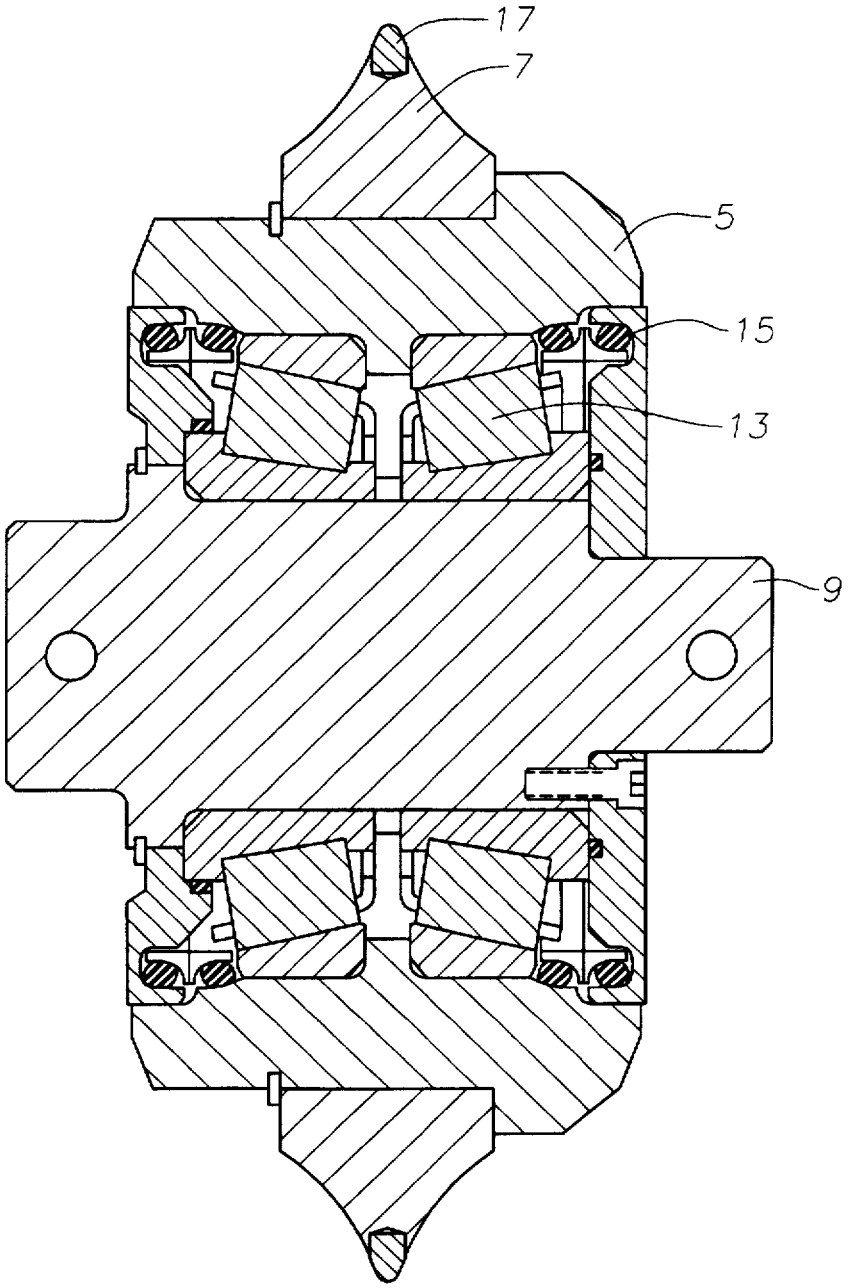
Fig. 3 (PRIOR ART)

FIGS. 2 and 3 are longitudinal section views of prior-art cutter assemblies of the type generally contemplated by the present invention. In both FIGS. 2 and 3, similar structure is numbered similarly. As stated above, generally cylindrical cutter shell or sleeve 5 is mounted for rotation on journal member 9. Kerf ring 7 is releasably secured to cutter shell or sleeve 5 by abutment with a radial shoulder on shell or sleeve 5 and is releasably retained there by a snap ring 11. Cutter shell or sleeve 5 rotates on tapered roller bearings 13, which are lubricated. Lubrication is retained in the bearing area by rigid face seals 15 comprising a pair of rigid seal rings energized and urged together by a pair of o-rings. A rigid face seal 15 is provided at each end of the cutter assembly.

In FIG. 2, a cutter assembly including a prior-art kerf ring 7 formed entirely of steel is illustrated. Kerf ring 7 has a generally rectangular or orthogonal base, from which a pair of generally concave and opposing sides converge to define a crest for engagement with and fracture of formation material. The steel kerf ring illustrated in FIG. 2 is generally satisfactory for use in softer, less abrasive formations, but tends to wear too quickly in harder, more abrasive formations.

FIG. 3 is a longitudinal section view of a cutter assembly as contemplated by the present invention, similar in all respects to that of FIG. 2, except that prior-art kerf ring 7 is provided with a plurality of hard metal inserts 17, preferably formed of cemented tungsten carbide, at the crest of kerf ring 7. In this prior-art embodiment, hard metal inserts 17 project beyond the crest of kerf ring 7 generally in a range from 0.250 to 0.500 inch. Hard metal inserts 17 are intended to increase the wear resistance of kerf ring 7 in harder, more abrasive formations. Nevertheless, because of the projection of inserts 17, the inserts 17, rather than the continuous crest of kerf ring 7, become the primary cutting structure and alter the mode in which formation material is fractured. Rather than scoring the formation in circular patterns in the fashion of a more conventional kerf ring 7 of a disc-type cutter, hard metal inserts 17 generate high point or contact stresses in relatively small areas of formation material, generating small cuttings and abrasive fines that can be destructive to bit components in addition to being difficult to remove from the shaft or tunnel.

Figure 4:
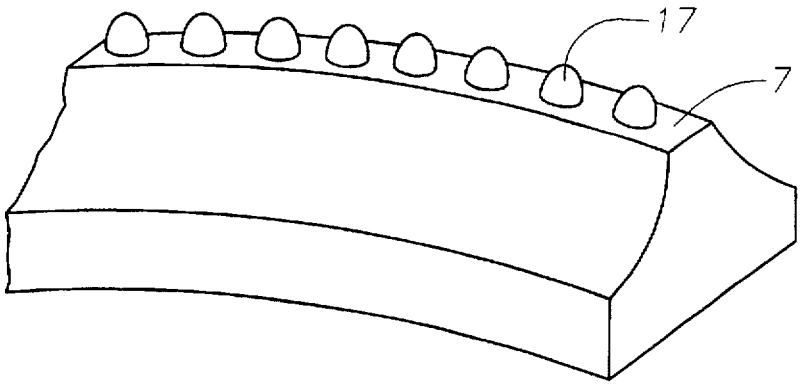
Fig. 4 (PRIOR ART)
FIG. 4 is an enlarged, fragmentary perspective section view of a prior-art kerf ring.

FIG. 4 is a fragmentary, perspective section view of a prior-art kerf ring of the type illustrated in FIG. 3. As can be seen, kerf ring 7 has a generally rectangular or orthogonal base from which a pair of generally concave sides converge to define a continuous crest. A plurality of hard metal inserts 17, preferably formed of cemented tungsten carbide, are secured by interference fit in the crest of kerf ring 7 and project beyond the crest of ring 7 with the attendant disadvantages discussed above.

Figure 5:
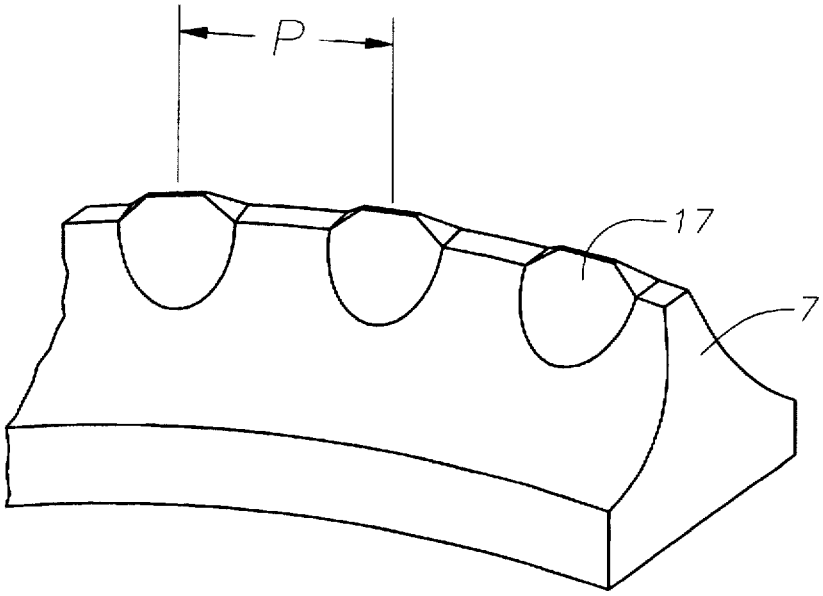
FIG. 5 is a fragmentary, perspective section view of a kerf ring according to the present invention.

FIG. 5 is a fragmentary, perspective section view of a kerf ring 7 according to the present invention, which is secured to cutter shells in a similar manner to that illustrated in FIGS. 2 and 3. Again, kerf ring 7 has a generally rectangular or orthogonal base having a pair of generally concave opposing sides converging to define a continuous crest. A plurality of hard metal inserts 17, preferably formed of cemented tungsten carbide, are embedded and secured by interference fit in kerf ring 7. The sides of inserts 17 generally are flush with the sides of kerf ring 7 and the crests of inserts 17 project beyond the crest of kerf ring 7 approximately 0.250 inch or less. According to the present invention, inserts 17 provide added wear resistance to kerf ring 7 while preserving the ring geometry and fracture mode conventionally employed by steel kerf rings of disc-type cutters (as illustrated in FIG. 2).

Figure 6:
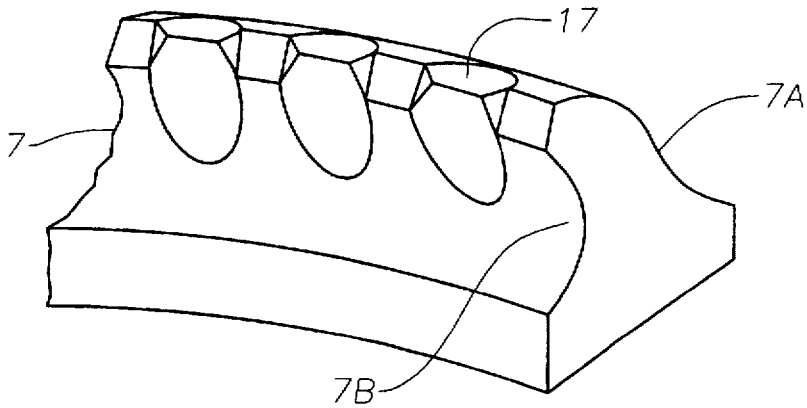
FIG. 6 is a fragmentary, perspective section view of a kerf ring according to the present invention.

FIG. 6 is a fragmentary, perspective section view of another kerf ring 7 according to the preferred embodiment of the present invention. In this embodiment, one convex side 7A and one concave side 7B extend from the rectangular or orthogonal base of kerf ring 7 to define a kerf ring that is curved in cross section. Again, hard metal inserts 17, preferably formed of cemented tungsten carbide are embedded and secured by interference fit to kerf ring 7 such that the sides of inserts 17 are generally flush with sides 7A, 7B of kerf ring. The crests of inserts 17 again project approximately 0.100 inch from the crest of kerf ring 7. The curved configuration of kerf ring of FIGS. 6 is particularly adapted for use in cutter assemblies at or near the periphery of bit body (1 in FIG. 1) and possess the ability to scrape and cut the gage or outer diameter of the shaft or tunnel being bored to maintain a full-diameter or full-gage bore.

To best utilize the advantageous fracture mode of disc-type cutters, it is useful to insure that kerf rings 7 of the cutter assemblies avoid "tracking" conditions. Tracking occurs when an insert falls in the same indentation previously made by the same or another insert. The regularity of the tracking condition leads to less efficient fracture of formation material.

Tracking can be avoided by adjusting the pitch P (as shown in FIG. 5), or center-to-center distance between adjacent inserts, measured where the insert intersects cutter shell surface 5. According to one preferred embodiment of the present invention, adjacent inserts are grouped in groups of three to seven, with pitch P varying between each pair of adjacent inserts, as disclosed in commonly assigned U.S. Pat. No. 4,316,515, Feb. 23, 1982 to Pessier, which is incorporated herein by reference.

Another tracking avoidance scheme according to the present invention is disclosed in commonly assigned U.S. Pat. No. 4,441,566, Apr. 10, 1984 to Pessier, which is incorporated herein by reference. In this embodiment, a "random" or dispersed pattern of inserts is obtained by arbitrarily placing or locating a first insert in the ring, locating a second insert in the ring randomly with respect to the first, locating a third insert arbitrarily with respect to the second, and so on to complete a row of inserts that is irregular, dispersed, or random in configuration.

The invention has been described with reference to preferred embodiments thereof. It is thus not limited, but is susceptible to variation and modification without departing from the scope of the invention.

I claim:

1. An improved earth-boring bit comprising:

a bit body;

at least one journal member having a pair of ends;

at least one saddle member secured to the bit body to receive and support each end of the journal member;

a cutter shell mounted for rotation on the journal member;

at least one kerf ring releasably secured to the cutter shell, the kerf ring including a pair of opposing sides that converge to define a crest for disintegration of formation material; and a plurality of hard metal inserts imbedded and secured in rows to the kerf ring, the inserts generally flush with the sides and extending to the crest of the kerf ring.

2. The earth-boring bit according to claim 1 wherein the inserts are separable into groups, each of the groups having varying pitch between the inserts.

3. The earth-boring bit according to claim 1 wherein the inserts are arranged such that a first insert is located arbitrarily in the kerf ring, a second insert is randomly located relative to the first, and a third insert is randomly located relative to the second, such that a dispersed insert pattern results.

4. The earth-boring bit according to claim 1 wherein one of the opposing sides of the kerf ring is convex and the other is concave, defining a kerf ring that is curved in cross section.

5. The earth-boring bit according to claim 1 wherein both of the opposing sides of the kerf ring are concave.

6. An improved earth-boring bit comprising:

a bit body;

at least one journal member having a pair of ends;

at least one saddle member secured to the bit body to receive and support each end of the journal member;

a cutter shell mounted for rotation on the journal member;

at least one kerf ring releasably secured to the cutter shell, the kerf ring including a pair of opposing sides that converge to define a crest for disintegration of formation material, one of the sides being concave and the other convex, wherein the kerf ring is curved in cross section; and a plurality of hard metal inserts imbedded and secured in rows to the kerf ring, the inserts generally flush with the sides and extending to the crest of the kerf ring.

7. The earth-boring bit according to claim 6 wherein the inserts are separable into groups, each of the groups having varying pitch between the inserts.

8. The earth-boring bit according to claim 6 wherein the inserts are arranged such that a first insert is located arbitrarily in the kerf ring, a second insert is randomly located relative to the first, and a third insert is randomly located relative to the second, such that a dispersed insert pattern results.

9. The earth-boring bit according to claim 6 wherein both of the opposing sides of the kerf ring are concave.

10. An improved earth-boring bit comprising:

a bit body;

at least one journal member having a pair of ends;

at least one saddle member secured to the bit body to receive and support each end of the journal member;

a cutter shell mounted for rotation on the journal member;

at least one kerf ring releasably secured to the cutter shell, the kerf ring having a generally rectilinear base with a pair of opposing sides that converge to define a crest for disintegration of formation material; and a plurality of hard metal inserts imbedded and secured in rows to the kerf ring, the inserts generally flush with the sides and extending to the crest of the kerf ring.

11. The earth-boring bit according to claim 10 wherein the inserts are separable into groups, each of the groups having varying pitch between the inserts.

12. The earth-boring bit according to claim 10 wherein the inserts are arranged such that a first insert is located arbitrarily in the kerf ring, a second insert is randomly located relative to the first, and a third insert is randomly located relative to the second, such that a dispersed insert pattern results.

13. The earth-boring bit according to claim 10 wherein one of the opposing sides of the kerf ring is convex and the other is concave, defining a kerf ring that is curved in cross section.

14. The earth-boring bit according to claim 10 wherein both of the opposing sides of the kerf ring are concave.

* * * * *

US005785135B1

REEXAMINATION CERTIFICATE (4078th)

United States Patent [19] [11] B1 5,785,135

Crawley [45] Certificate Issued May 2, 2000

[54] EARTH-BORING BIT HAVING CUTTER WITH REPLACEABLE KERF RING WITH CONTOURED INSERTS

[75] Inventor: Dolph Crawley, Arlington, Tex.

[73] Assignee: Baker Hughes Incorporated, Houston, Tex.

Reexamination Request:
No. 90/005,252, Mar. 15, 1999

Reexamination Certificate for:

| | |
|---|---|
| Patent No.: | **5,785,135** |
| Issued: | **Jul. 28, 1998** |
| Appl. No.: | **08/724,875** |
| Filed: | **Oct. 3, 1996** |

[51] Int. Cl.[7] ..... E21B 9/08
[52] U.S. Cl. ..... 175/373
[58] Field of Search ..... 175/373, 374, 175/376, 426, 431

[56] References Cited

U.S. PATENT DOCUMENTS 3,679,009 7/1972 Goodfellow .
4,316,515 2/1982 Pessier .
4,441,566 4/1984 Pessier et al. .

FOREIGN PATENT DOCUMENTS 1479374 7/1977 United Kingdom .
WO 93 12320 6/1993 WIPO .

*Primary Examiner*—William P. Neuder

[57] ABSTRACT

An earth-boring bit or head of the shaft or tunnel boring variety has a generally circular bit body. A plurality of saddle members are secured to bit body to receive and support each end of a plurality of corresponding journal members. A cutter shell or sleeve is mounted for rotation on bearings on each journal member. At least one kerf ring is releasably secured to the cutter shell. The kerf ring includes a pair of opposing sides that converge to define a continuous crest for disintegration of formation material. A plurality of hard metal inserts are embedded and secured in rows to the kerf ring, the inserts being generally flush with the sides and extending to the crest of the kerf ring.

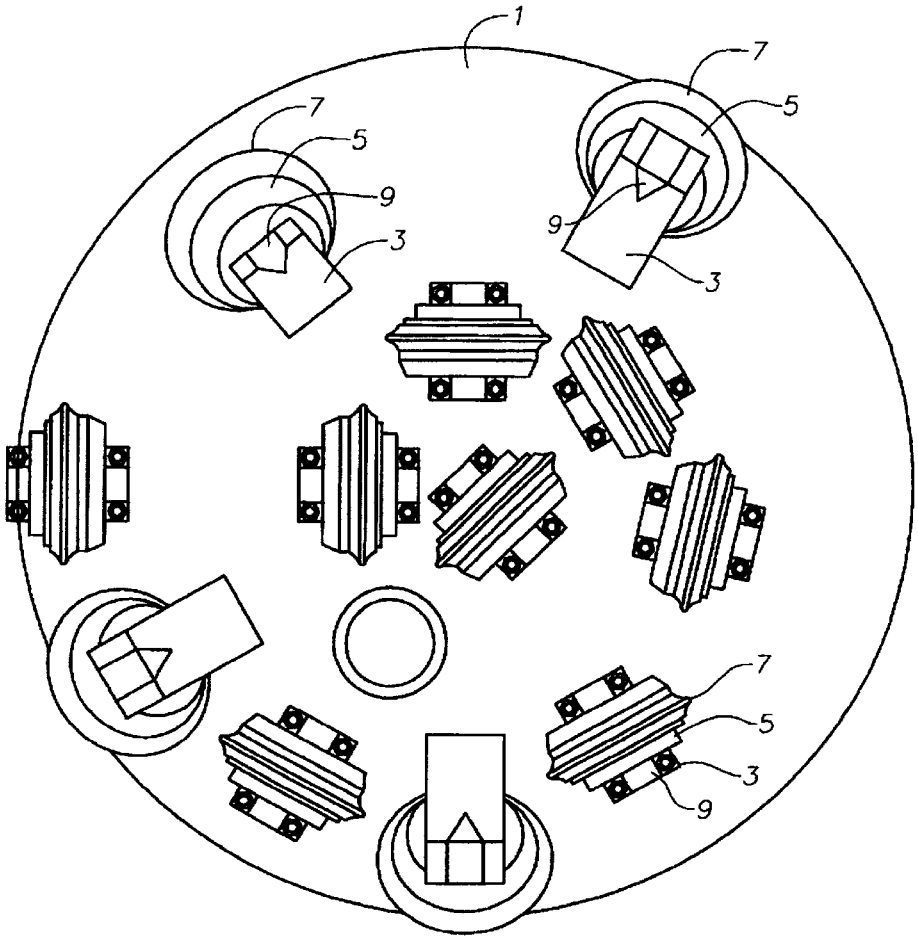

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claims 2, 10, 11, 12 and 14 are cancelled.

Claims 1 and 13 are determined to be patentable as amended.

Claims 3–9, dependent on an amended claim, are determined to be patentable.

New claims 15–17 are added and determined to be patentable.

1. An improved earth-boring bit comprising:

a bit body;

at least one journal member having a pair of ends;

at least one saddle member secured to the bit body to receive and support each end of the journal member;

a cutter shell mounted for rotation on the journal member;

at least one kerf ring releasably secured to the cutter shell, the kerf ring including a pair of opposing sides that converge to define a crest for disintegration of formation material; and a plurality of hard metal inserts imbedded and secured in rows to the kerf ring, the inserts generally flush with the sides and [extending to] *projecting from* the crest of the kerf ring.

13. [The earth-boring bit according to claim 10] *An improved earth-boring bit comprising:*

*a bit body;*

*at least one journal member having a pair of ends;*

*at least one saddle member secured to the bit body to receive and support each end of the journal member;*

*a cutter shell mounted for rotation on the journal member;*

*at least one kerf ring releasably secured to the cutter shell, the kerf ring having a generally rectilinear base with a pair of opposing sides that converge to define a crest for disintegration of formation material;*

*a plurality of hard metal inserts imbedded and secured in rows to the kerf ring, the inserts generally flush with the sides and extending to the crest of the kerf ring wherein the inserts are separable into groups, each of the groups having varying pitch between the inserts; and* wherein one of the opposing sides of the kerf ring is convex and the other is concave, defining a kerf ring that is curved in cross section.

*15. The earth-boring bit according to claim 3 wherein one of the opposing sides of the kerf ring is convex and the other is concave, defining a kerf ring that is curved in cross section.*

*16. The earth-boring bit according to claim 3 wherein both of the opposing sides of the kerf ring are concave.*

*17. An improved earth-boring bit comprising:*

*a bit body;*

*at least one journal member having a pair of ends;*

*at least one saddle member secured to the bit body to receive and support each end of the journal member;*

*a cutter shell mounted for rotation on the journal member;*

*at least one kerf ring releasably secured to the cutter shell, the kerf ring having a generally rectilinear base with a pair of opposing sides that converge to define a crest for disintegration of formation material;*

*a plurality of hard metal inserts imbedded and secured in rows to the kerf ring' the inserts generally flush with the sides and extending to the crest of the kerf ring wherein the inserts are separable into groups, each of the groups having varying pitch between the inserts;*

*wherein the inserts are arranged such that a first insert is located arbitrarily in the kerf ring, a second insert is randomly located relative to the first, and a third insert is randomly located relative to the second, such that a dispersed insert pattern results; and*

*wherein one of the opposing sides of the kerf ring is convex and the other is concave, defining a kerf ring that is curved in cross section.*

* * * * *